United States Patent [19]

Niedecker

[11] 4,166,571

[45] Sep. 4, 1979

[54] U-SHAPED SHUT-OFF CLIPS

[76] Inventor: Herbert Niedecker, Am Ellerhang 6, Königstein 2, Fed. Rep. of Germany, 6240

[21] Appl. No.: 766,419

[22] Filed: Feb. 7, 1977

[51] Int. Cl.[2] ..... B65D 33/30; B65D 77/10

[52] U.S. Cl. ..... 229/65; 24/30.5 W; 24/115 A; 85/49

[58] Field of Search ..... 24/30.5 R, 30.5 W, 27, 24/115 A, 20 R, 20 LW; 229/62, 65; 85/31, 49

[56] References Cited

U.S. PATENT DOCUMENTS

| | | | |
|---|---|---|---|
| 2,988,854 | 6/1961 | McKinley | 85/31 |
| 3,363,628 | 1/1968 | Wood | 24/30.5 W |
| 3,473,430 | 10/1969 | Niedecker | 24/30.5 W |

FOREIGN PATENT DOCUMENTS

| | | | |
|---|---|---|---|
| 2461175 | 6/1976 | Fed. Rep. of Germany | 24/30.5 W |

*Primary Examiner*—Werner H. Schroeder
*Assistant Examiner*—Moshe I. Cohen

[57] ABSTRACT

A U-shaped shut-off clip for bags, flexible tubes or the like, having an over-all uniform cross-sectional area comprising opposed limbs interconnected by a web at transitory points, said limbs having a pliability-prone segment therein.

9 Claims, 7 Drawing Figures

U-SHAPED SHUT-OFF CLIPS

This invention relates to a U-shaped clip which is intended to close bags, flexible tubes or the like and has been made from a piece of wire which is constant in cross-section throughout its length.

There are two basic types of clips which are intended to close bags, flexible tubes or the like. Clips of one kind are made in that strip material is shaped by embossing operations, in most cases in several stages, to form clips, which are joined in a strip to form a supply of clips, which in this form are introduced into the closing machine, in which each clip is severed from the strip immediately before the closing operation. The embossing or other shaping tools may be designed so that the shaped clip has a cross-sectional shape which is suitable with a view to the intended purpose. The clips may have different cross-sectional shapes in the limbs and web (see, e.g., Printed German Application No. 1,761,616).

Clips of the other basic kind are made from wire material, which is cut into pieces, which are shaped to a clip. These clips are in most cases U-shaped. In this shaping operation the cross-section of the piece of wire remains constant throughout its length, apart from the upsetting and stretching of the material due to the bending. The starting material is in most cases circular in cross-section or has other cross-sectional shapes with a view to special applications (see, e.g., Opened German Specification Nos. 1,536,183 and 1,959,755). A supply of clips of this kind is formed in that a plurality of individual clips are juxtaposed with the same orientation and are joined by means of adhesive material or the like to form a "bar".

When a flexible packaging tube is to be closed with a U-shaped clip, the tube is gathered and is then embraced with the clip. The two open limbs of the U-shaped clip are then bent inwardly on a concave die, which has one or more slide grooves. As a result, the end of the casing is firmly closed. To avoid a spontaneous opening of the clip, it must resist the static restoring force which is exerted by the closed end. In some cases, a liquid-tight, fat-tight or air-tight seal is required.

It has now been found in practice that the clips of the last-mentioned kind have certain disadvantages. Particularly the behavior of said clips during and after the closing operation is often unsatisfactory. Filled bags and flexible tubes are usually closed by a machine in an operation in which a punch pushes the clip over the gathered end portion of a flexible tube and drives the clip onto the die. In this operation the limb ends in one slide groove or in two parallel slide grooves until the end portions of the tube is firmly embraced. The end faces of the limb ends may either form a butt joint or the grooves may be so designed that these end faces move past one another.

The limb ends will most effectively resist the restoring force exerted by the closed end of the casing if they extend as exactly parallel as possible to the web of the clip when the same is in its final position, and it would even be desirable to give a slight bend to the limb ends. Whereas it has been attempted to provide for this desired bend in that the U-shaped clip is slightly bent inwardly before or is beveled on the outside, both measures have proved unsatisfactory. Prebending results in a decrease of the open cross-sectional area so that larger clips, which involve a higher expenditure of material, are required for a given cross-section to be closed. The ends of such clips are often reversely bent inwardly to an excessively large extent so that they damage the gathered casing. In the use of clips having beveled limb ends it has been found that the inside surfaces of the limb ends were not bent inwardly to a sufficiently large extent opposite to the bevels so that a sufficiently large closing pressure often cannot be applied in this region. This may result in an uncontrolled opening of the closure and consequently in a loss or spoiling of the content.

To ensure that the plastic deformation of the clip can be initiated without upsetting when the limb ends have engaged the die, that region of the latter which is initially engaged by the leg ends must be sufficiently steep, but this would result in the disadvantage that the closed clip would not have the desired shape. The flatter the portion of the die which is initially engaged by the clip, the higher is the risk that the clip is upset during its plastic deformation. It is not possible to adopt a compromise in designing the die. When prebent or beveled limb ends suddenly engage the die, the clips are also upset and/or improperly bent so that trouble arises in the operation of the closing machines and unsatisfactory closures result. This result has not been substantially improved even by the application of a suitable lubricant to the end face of the limb ends.

For this reason it is an object of the invention to provide a clip which is of the kind defined first hereinbefore and which is improved in that its limbs can be bent inwardly more easily and more reliably during the closing operation, that perfectly tight closures are obtained, and that damage to the bags, flexible tubes or the like is avoided. At the same time, the manufacturing costs should not be increased or should not be substantially increased.

It is an object of this invention to provide an improved shut-off clip whose limbs, during the sealing action, bend consistently inward with greater ease, thus ensuring a perfect, watertight shut-off without damaging the bag, flexible hose, or the like. To gain the benefit of this comparatively simple invention, production costs need not be increased to any excessive amount.

SUMMARY OF THE INVENTION

The problems attendant prior art shut-off clips are solved by providing the uniform cross-sectional area of the limbs of the shut-off clip with a "pliability-prone segment".

A pliability-prone segment implies a certain area of the limbs which will predictably give way under a prescribed load, i.e. it will conform to the direction of shut-off.

Accordingly, the present invention contemplates a U-shaped shut-off clip for bags, flexible tubes, or the like, having an over-all uniform cross-sectional area and comprising opposed limbs interconnected by a web at a transitory point, said limbs having a pliability-prone segment therein.

To achieve the above, the pliability-prone segment includes an area approximately 1/5 to ⅓ the length of one limb away from the free end of the limb. Carrying this basic concept a step further, the pliability-prone segment has a reduced portion of the sectional area of the limbs which can be provided with sickle- or prism-shaped notches cut horizontally to the length of the limb. To achieve the desired degree of pliancy, the outer surface of the limbs is notched. Depending on the type of material used and the purpose in mind, the sectional area of the notching should be reduced by 60 to 90% or, ideally, approximately 70%. Thus the notch may be cut more deeply, the further it is located away from the tip of the limb.

Another advantage in using a sickle-shaped notch for the pliability-prone segment covering half of the outer circumference of the limbs is that, during the sealing action, the tips of both limbs bypass each other and touch the other limb, greatly decreasing the risk of puncturing and providing a neat shut-off.

To prevent the notch from splitting, it is essential to envisage a contour not prone to break-off. Using this method, by stamping a mold which is shatter-proof, the material comprising the sides partially, or if additional smoothing of the curbed area is provided, completely encompasses the longitudinal median so that an extended length of the shut-off clip proportionately shorter may be selected. In view of the mass quantity of such an item and the prohibitive cost of the basic material, the amount of material saved by using this method represents a considerable reduction in expense.

Another advantage of the type of shut-off clip provided by this invention is the fact that the tips of the open limbs are tapered or beveled but only within the limits of the outer cross-sectional half. If, in this instance, a shatter-proof mold is used, the amount of material saved totals roughly 5%, representing significant reductions in expense.

BRIEF DESCRIPTION OF THE DRAWINGS

Further details of the type shut-off clip of this invention are given in the appended figures wherein.

DETAILED DESCRIPTION OF THE DRAWINGS

Figure 1:
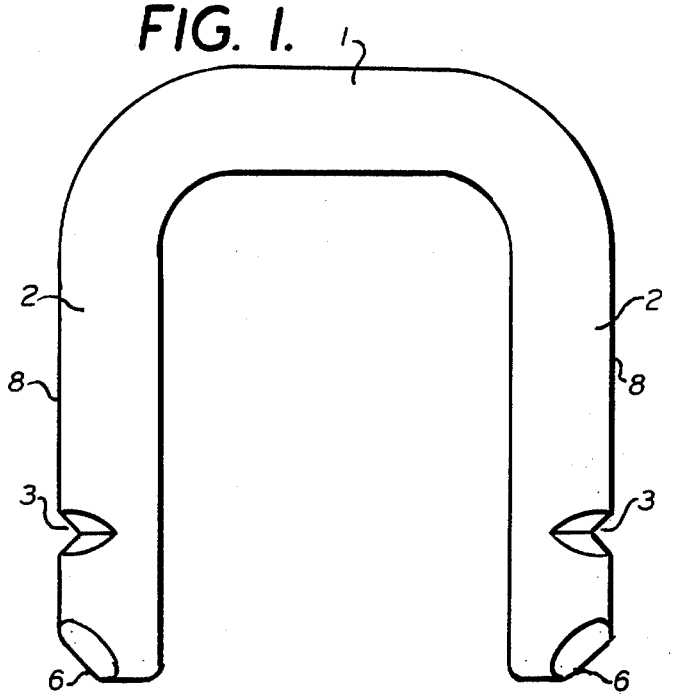
FIG. 1 is a slide view of a clip in accordance with the invention.

Referring now more particularly to the drawings:

FIG. 1 shows a side view of a U-shaped shut-off clip (1) in which a notch can be seen in the detailed pliability-prone segment (3) on the outer surface (8) of the clip limb (2) as profiled. Tapering of the tips of both limbs (6) is also shown in FIG. 1.

Figure 2:
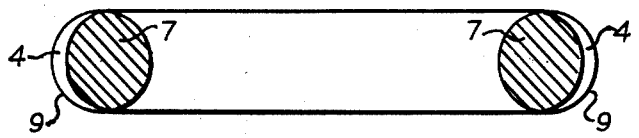
FIG. 2 is a horizontal section through the notch of FIG. 1.

FIG. 2 shows a segment of the shut-off clip (1) as per this invention, corresponding to the line of intersection in FIG. 1. The outer cross-sectional half (9) reveals a sickle-shaped notch (4) by which the cross-sectional area of limb (7) is reduced to form a plaibility-prone segment.

Figure 3:
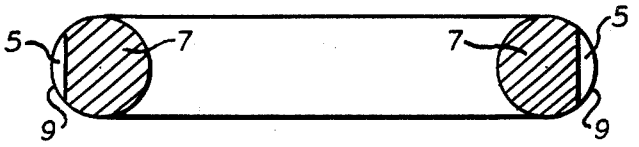
FIG. 3 is a horizontal section through a notch of different shape.

FIG. 3 shows a segment of shut-off clip (1) similar to FIG. 2 but with prism-shaped notching (5).

Figure 4A:
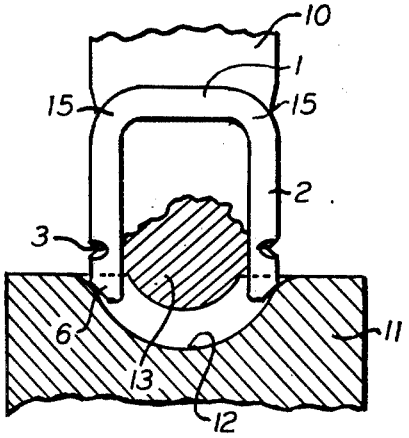
FIGS. 4*a*, 4*b* and 4*c* illustrate successive stages of the clip in closing to encircle a bag.
Figure 4B:
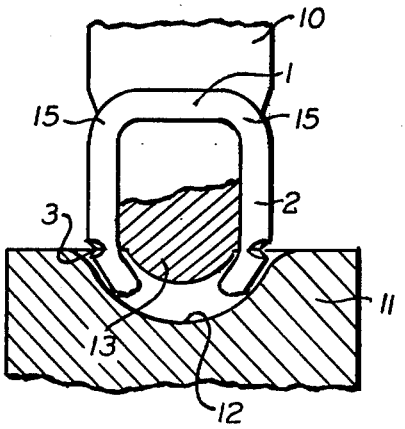
Figure 4C:
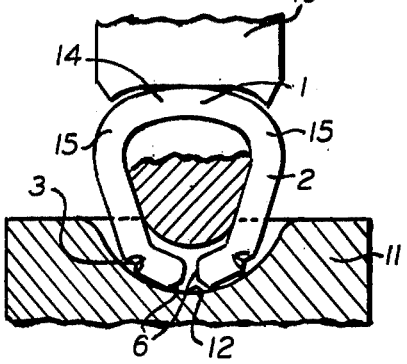

FIGS. 4*a* to 4*c* illustrate the three stages of shut-off clip (1) as per the invention. The clip is gripped by a press (10), slid over the twisted or gathered bag or flexible tube extremity (13) and driven against a die (11) which has a concave curve (12). When the tapered ends of the limbs (6) are applied to the curve of the form (12), a power component is exerted upon the limbs (2) in the direction of shut-off, causing the ends of the limbs (6) to buckle inward due to the notching in the pliability-prone segment (3), thus initiating the shut-off action characterized by the plastic molding of the shut-off clip (Cf. FIG. 4*b*).

FIG. 4*c* shows a more advanced stage of shut-off action wherein the ends of the limbs (6) have already slid considerably towards each other along the curvature (12) of the die (11) with the two limbs (2) beginning to bend in a circular form. The web (14) spanning the two limbs (2) is also curved since the shut-off clip material (1) in the rounded areas (15) has a cold rigidity, the result being that these areas remain virtually unaffected by the bending during shut-off action. To a much greater degree, the ends of the limbs (6) either give way and bypass each other or meet head-on bringing their relative movement to a halt and instantly cause the limbs (2) and the web (14) to conform to the shut-off mold.

Figure 5:
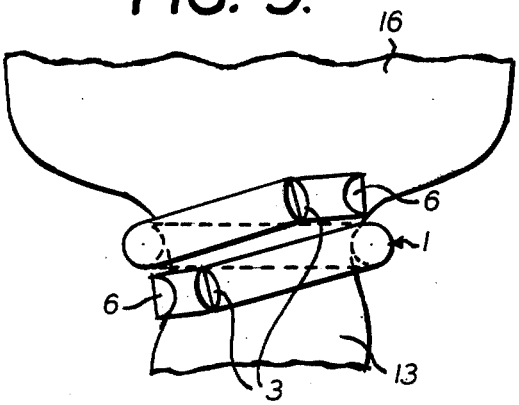
FIG. 5 is a side elevation of a closed clip encircling a bag.

FIG. 5 is a side elevation showing a disposition of the limbs (6) after the sealing action in which the end portions of the limbs bypass one another and encompass the bag or flexible tube.

Figure 6:
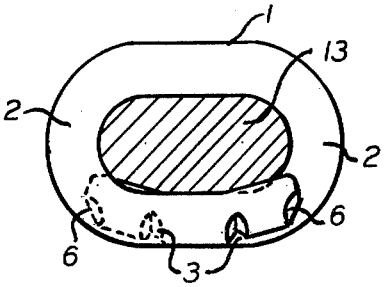
FIG. 6 is a plan view partially in phantom showing the structure of FIG. 5.

FIG. 6 is a plan view partially in phantom showing the disposition of the shut-off clip according to FIG. 5.

Figure 7:
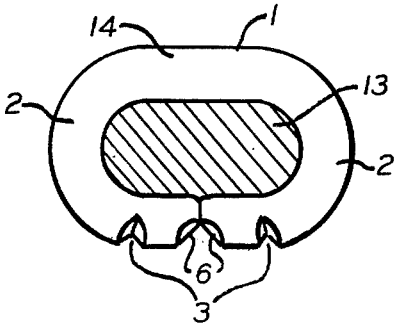
FIG. 7 is a view similar to FIG. 6 of another closed clip where the ends butt rather than lap.

FIG. 7 is a view similar to FIG. 6 showing insides (6) meeting head-on in facing relationship to one another.

The varied shut-off actions represented by FIGS. 6 and 7 are responsive to corresponding shapes of the die. The specific design of the die is within the purview of the skilled artisan.

In addition to the ease with which shut-off action is initiated and the fact that the clip limbs bend only to the degree desired, another advantage of the pliability-prone segment is that the area between the pliability-prone segment itself (3) and the extremities of the limbs (6) remains virtually unbent so that they are almost straight and finally move inward in the direction of the gathered bag or flexible tube. In the detailed form shown in FIG. 6, the extremities of the limbs (6) tend inward as a result of notching, thus eliminating any possibility of damage. Furthermore, the extremities, having bypassed one another, lodge more securely (FIG. 5), resulting in a tighter shut-off better suited to resist any unforeseen upward bending of the shut-off clip.

It will be appreciated that the instant specification is set forth by way of illustration and not limitation, and that various modifications and changes may be made without departing from the spirit and scope of the present invention.

What is claimed is:

1. An open-mouthed container closed by a clip having an over-all uniform cross-sectional area and comprising opposed limbs interconnected by a web at transitory points, said limbs having a notch cut on the outside of each limb as a pliability-prone segment therein, aiding the bending of each limb toward the other limb away from its respective notch, the clip in its open state being U-shaped, whereby the enclosed container is remote from the notches so as not to be damaged thereby.

2. A structure according to claim 1, wherein the pliability-prone segment is disposed at a point on both limbs of said clip from the limb extremity a distance between 1/5 and ⅓ of the total length of the limb.

3. A structure according to claim 1, wherein said pliability-prone segment comprises a local reduction of the limb's cross-section.

4. A structure according to claim 3, wherein said pliability-prone segment is in the form of a prism-shaped notch cut horizontally to the direction of the length of the limb.

5. A structure according to claim 3, wherein the local reduction of each limb's cross-section amounts to 60 to 90% of its total cross-sectional area.

6. A structure according to claim 5, wherein the local reduction of each limb's cross-section amounts to 70% of its total cross-sectional area.

7. A structure according to claim 1, wherein said pliability-prone segment is in the form of a sickle-shaped notch cut horizontally to the direction of the length of the limbs.

8. A structure according to claim 1, wherein the free extremities of the limbs are tapered.

9. A structure according to claim 8, wherein said tapering is confined to only the outer half of the cross-section of the limbs.

* * * * *